United States Patent [19]

Hospes

[11] 4,384,654

[45] May 24, 1983

[54] TEAR-OFF CLOSURE

[75] Inventor: Robert E. Hospes, Richmond, Ind.

[73] Assignee: Aluminum Company of America, Pittsburgh, Pa.

[21] Appl. No.: 271,811

[22] Filed: Jun. 8, 1981

[51] Int. Cl.[3] ..... B65D 41/58

[52] U.S. Cl. ..... 215/256; 215/254; 215/353

[58] Field of Search ..... 215/353, 254, 256

[56] References Cited

U.S. PATENT DOCUMENTS

| | | | |
|---|---|---|---|
| 3,073,472 | 1/1963 | Williams | 215/256 |
| 3,189,208 | 6/1965 | Jowett | 215/38 |
| 3,840,137 | 10/1974 | Faulstich | 215/256 |
| 3,940,004 | 2/1976 | Faulstich | 215/256 |
| 3,979,002 | 9/1976 | Faulstich | 215/256 |
| 4,106,653 | 8/1978 | Martinelli | 215/256 |
| 4,162,736 | 7/1979 | Faulstich | 215/256 |

FOREIGN PATENT DOCUMENTS

| | | | |
|---|---|---|---|
| 1526780 | 4/1968 | France | 215/256 |

*Primary Examiner*—Donald F. Norton
*Attorney, Agent, or Firm*—Max L. Williamson

[57] ABSTRACT

A tear-off closure having a collar flaring downwardly and outwardly from a terminal edge of a cap portion of the closure, the collar provided to shield a portion of a bottle with the closure applied thereon from contamination. At least one line of weakening is provided in the collar to enable tearing at least the collar for convenient removal of the closure from a bottle.

8 Claims, 6 Drawing Figures

TEAR-OFF CLOSURE

BACKGROUND OF THE INVENTION

This invention relates to a tear-off closure for use with a bottle and more particularly to a closure having an outwardly flaring collar depending from the skirt wall, the collar adapted to intimately contact a portion of the bottle and thus shield the neck and upper exterior portion of the bottle from contamination.

In some usages of bottles for dispensing liquids, it is important to provide a clean exterior surface on the bottle neck and a substantial portion of the bottle adjacent the neck. In one method of dispensing drinking water, for example, water is provided in a bottle having a neck and a generally frustoconically shaped portion flaring outward from the neck connecting a cylindrically shaped container portion of the bottle. A closure is applied to cover the mouth and at least some portion of the bottle neck to prevent contamination of the covered portion of the bottle neck. At the point of dispensing the water from the bottle, the closure is removed from the bottle and the bottle is then inverted into an opening in a water dispensing unit. Typically, the bottle rests upon a sealing ring within the opening to a water chamber in the unit, and thus the exterior portion of the neck and a surrounding portion of the bottle within a zone defined by the cirumference of the sealing ring are exposed to a chamber in the dispensing unit into which the water enters. It is apparent that in dispensing water in this manner it is important to maintain a clean exterior surface on the portions of the bottle exposed to the water chamber.

Faulstich U.S. Pat. No. 3,840,137 and Martinelli U.S. Pat. No. 4,106,653 describe closures that have been suggested for use with water bottles. The patentees describe closures which include a skirt wall protecting at least a portion of the exterior of a bottle neck and a tearable portion to enable a user to quickly and conveniently remove the closure from the bottle.

Neither of the above-mentioned patents describes a closure which shields or protects an exterior surface of a bottle extending beyond the exterior surface of the neck. It would be desirable, therefore, to provide a closure which completely protects from contamination the exterior surface of a bottle which becomes exposed to water being dispensed from the bottle when the bottle is placed in a dispensing unit.

SUMMARY OF THE INVENTION

The subject invention is a tear-off closure having an imperforate collar flaring downwardly and outwardly from the bottom edge of a substantially cylindrical skirt wall. The collar, when applied to a bottle, is adapted to be in intimate contact along its outer peripheral edge with a portion of a bottle adjacent the bottle neck in order to shield and protect from contamination the exterior of the bottle within the confines of the closure. At least one line of weakening is provided in the collar to enable the collar to be torn prior to dispensing the contents of the bottle so that the closure may be quickly and easily removed. To facilitate tearing of the collar, gripping means is provided adjacent the line of weakening.

It is an advantage of a closure of this invention that the exterior of a bottle neck and a portion of the bottle adjacent the neck are protected from contamination when the closure is applied to the bottle.

It is also an advantage that a closure of this invention is provided with at least one line of weakening to enable the closure to be torn and provide a rapid, convenient method of removing the closure.

It is a further advantage of this closure that gripping means is provided adjacent the line of weakening to facilitate tearing of the closure.

These and other advantages of a closure of this invention will be more fully understood and appreciated with reference to the following description and associated drawings.

DESCRIPTION OF A PREFERRED EMBODIMENT

For purposes of describing a preferred embodiment of this invention, a closure for use with a 5-gallon drinking water bottle is shown and described, but it is not intended that the scope of the invention is limited to any particular use.

The preferred material for making a closure of this invention is low density polyethylene, but other plastic materials such as high density polyethylene or ethyl vinyl acetate, for example, may also be used.

Figure 1:
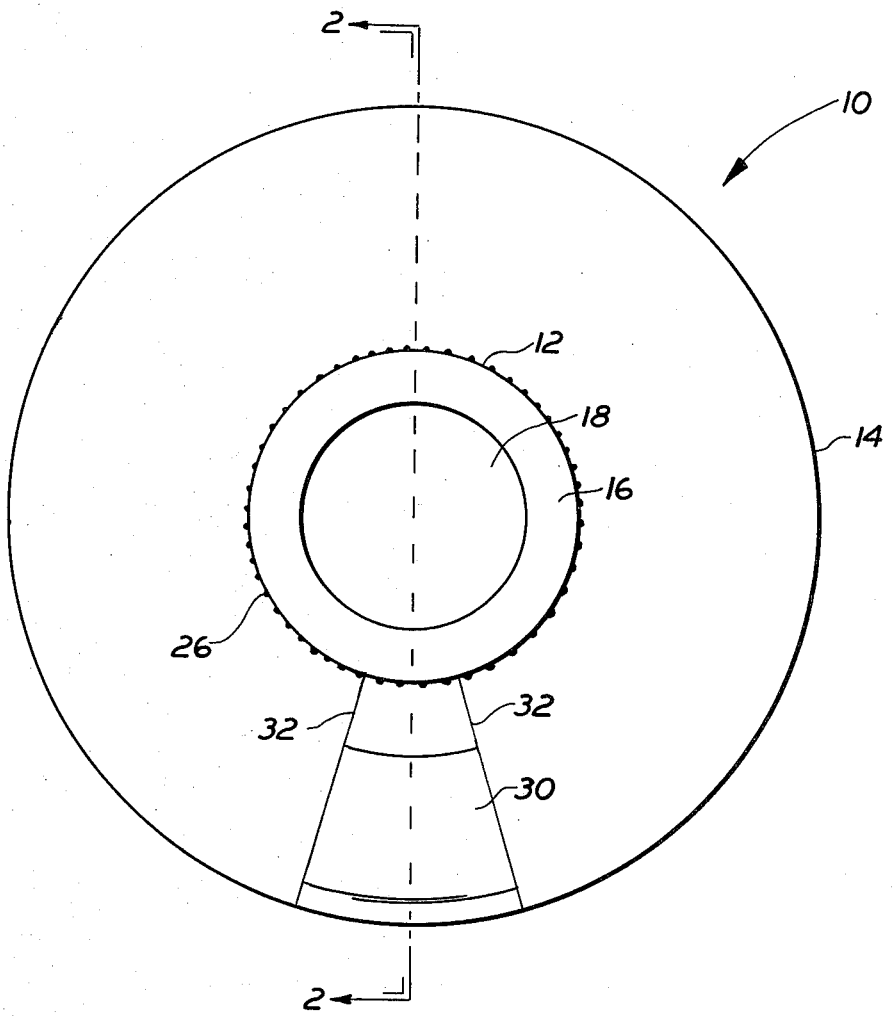
FIG. 1 is a top plan view of a closure of this invention.
Figure 2:
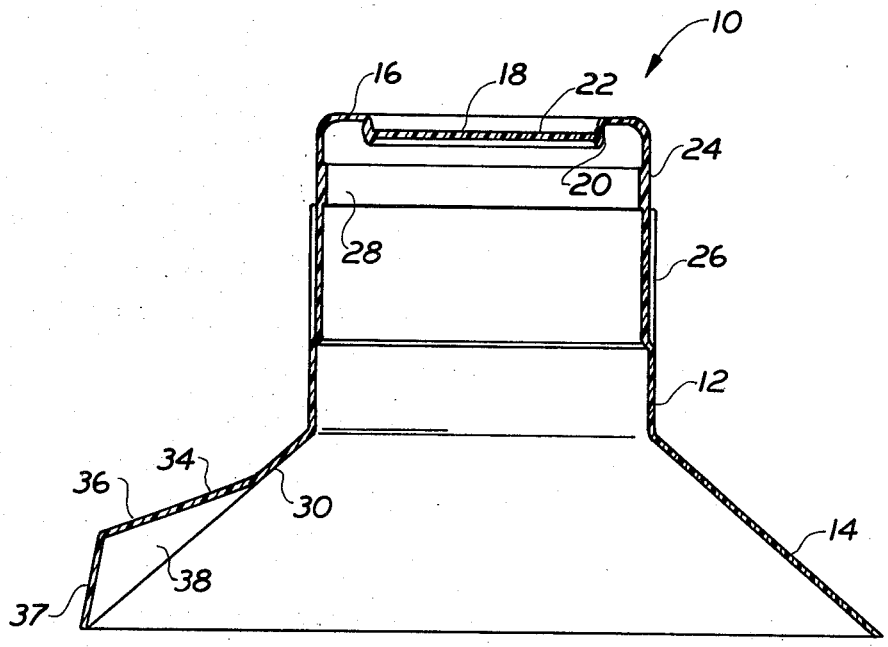
FIG. 2 is an elevation cross-sectional view of FIG. 1 along section line 2—2.

Referring to FIGS. 1 and 2, the closure 10 is comprised of a cap portion 12 and an imperforate collar portion 14. The cap portion 12 includes an end wall 16 having a central plug portion 18 depending therefrom. The plug portion 18 is comprised of a cylindrical wall 20 depending from the annular top wall 16, and a planar disc 22 near the bottom edge of the cylindrical wall is provided to close the circular opening. A substantially vertical outer skirt wall 24 depends from the outer edge of the end wall 16. A knurled outer surface 26 is provided on the skirt wall to afford easy gripping of the closure and an inwardly projecting band 28 adjacent the top edge of the skirt wall 24 functions to aid in sealing and retaining the closure on a bottle, as will be explained later.

Figure 3:
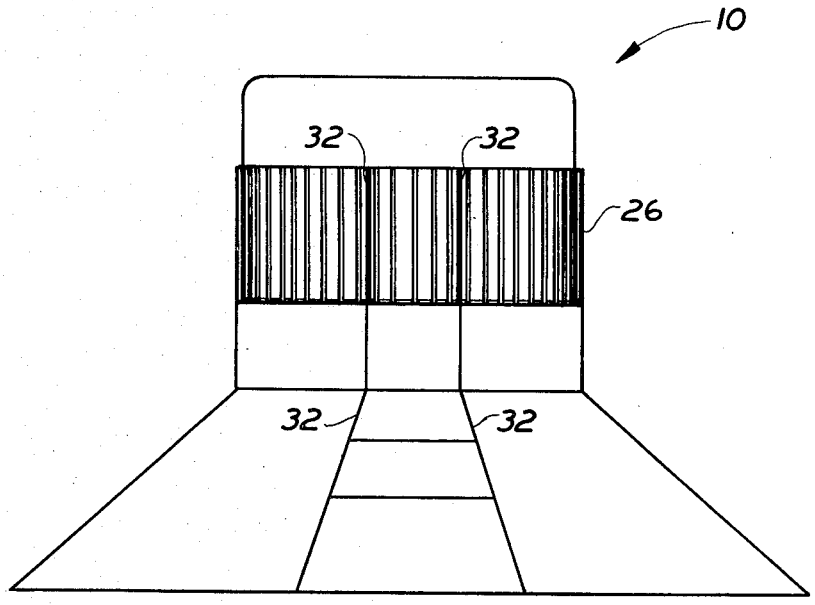
FIG. 3 is an elevation view of the cap portion of the closure.

The collar 14 flares downwardly and outwardly from the bottom edge of the skirt wall 24 and has a substantially frustoconical shape. A weakened wall section 30 extends from the outer edge of the collar 14 radially inward to the bottom edge of the skirt wall 24 and then extends upward in the skirt wall for a distance sufficient to remove the closure when the weakened wall section is torn away, as will be explained later. The weakened wall section 30 is defined by spaced lines of weakness 32, 32 which are molded grooves of reduced wall thickness in relation to the wall thickness of the material adjacent to the lines in this preferred embodiment, but it is apparent that the lines could be made by scribing. In this preferred embodiment, the grooves were disposed in the collar 14 with a 33° angle of arc therebetween. This angle was found to be suitable for the particular use of the closure with a water bottle, but the invention is not limited to any particular angular disposition of the grooves 32, 32. From the bottom of the skirt wall 24, the grooves 32, 32 extend upwardly, parallel to one another, in the skit wall 24 to the top of the knurls 26 as may be seen in FIG. 3. It is apparent that it is necessary that the grooves 32, 32 need to extend upwardly through the skirt wall 24 only a distance sufficient to enable the closure to be removed from a bottle after tearing away the weakened portion 30.

In this preferred embodiment a grippable portion 34 of the collar 14 is provided within the weakened wall portion 30 to enable tearing away the weakened wall portion 30 of the closure. The grippable portion 34 comprises a top wall 36 projecting upwardly and outwardly from the upper surface of the collar 14, an end wall 37 projecting downward from the outer end of the top wall 36 to the outer peripheral edge of the collar 14, and triangular shaped side walls 38, 38 having a lower edge joining the upper surface of the collar 14 and the remaining two edges of the side walls joining outer edges of the top wall 36 and end wall 37.

Figure 4:
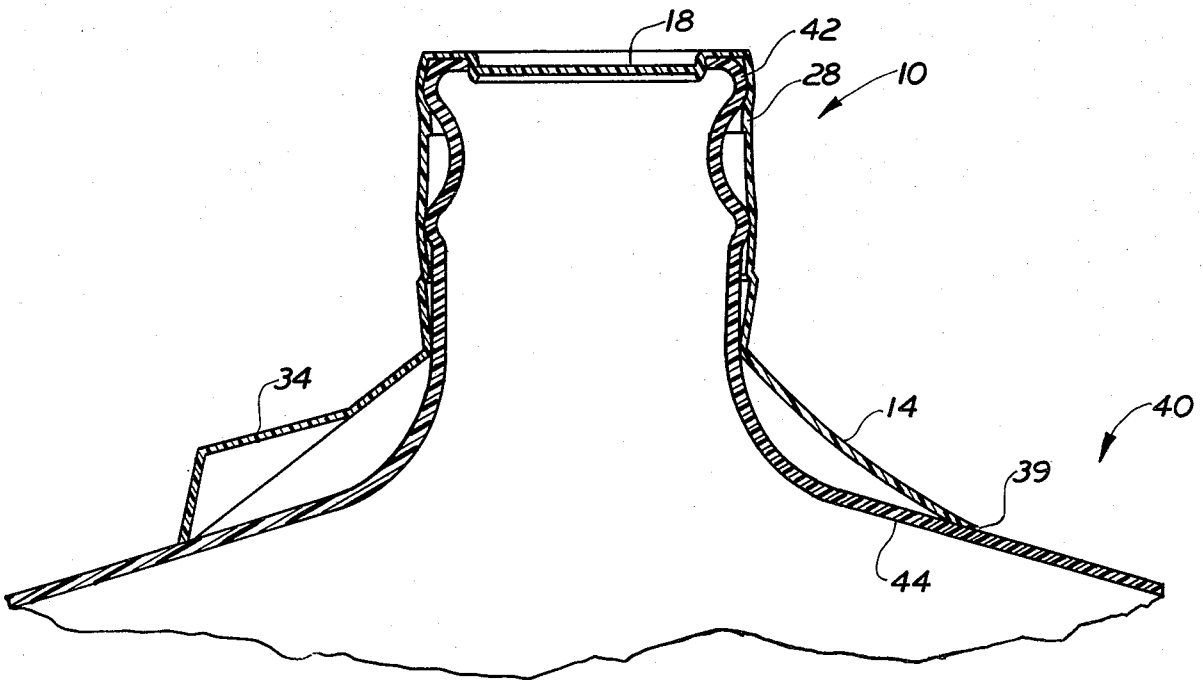
FIG. 4 is a cross-sectional view of the closure of FIG. 1 assembled with a bottle.

Referring now to FIG. 4, a closure of this invention is shown assembled with a bottle 40. To effect the assembly shown in FIG. 3, the closure 10 is positioned above the bottle 40 and the closure is pressed downward so as to force the plug 18 into the mouth of the bottle 40 and cause the annular band 28 to engage an outwardly projecting lip portion 42 of the bottle 40. Downward pressure on the closure 10 also forces the outer peripheral edge 39 of the collar 14, which is in intimate contact with the bottle 40, to flare outwardly. Thus, it may be seen that a portion of the collar 14 adjacent the peripheral edge 39 provides a seal between the closure 10 and bottle 40 and prevents foreign material from contaminating the bottle in a zone within the closure.

To insure that a tight seal is established and maintained, the inside angle between vertical and the flare of the collar 14 is less than the inside angle between vertical and the flare of the bottle 40 an amount sufficient to impose a strain on the collar 14. FIG. 4 shows the collar 14 as assuming a slightly curved position from the downward pressure applied in assembling the closure with the bottle. The collar 14 assumes this position from the imposed strain on the collar 14 and imparts to it a spring-like quality which maintains a tight peripheral seal between the collar and the bottle.

Figure 5:
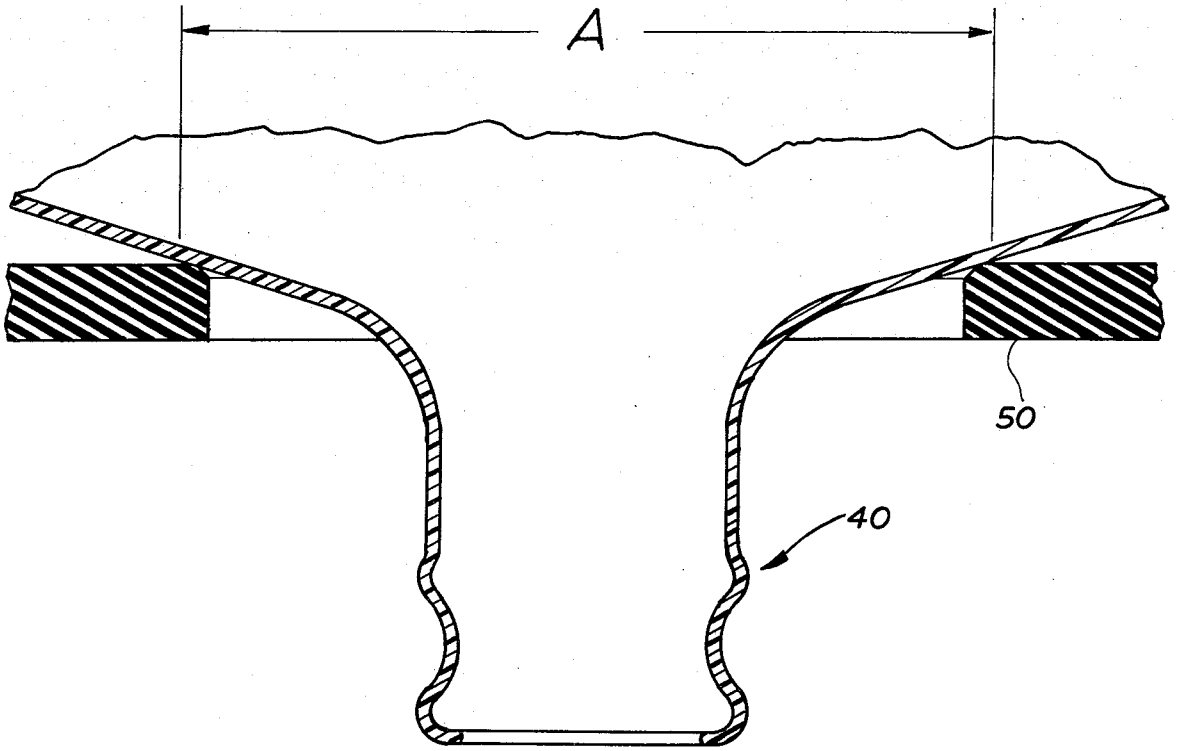
FIG. 5 is a cross section of a bottle in a dispensing position in a dispensing unit.

In preparation for dispensing the water contained within the bottle, the grippable portion 34 of the closure is gripped between a thumb and finger and pulled upwardly causing the closure to tear along the grooves 32, 32 and thus freeing the weakened wall portion 30 for removal of the closure. After the closure 10 is removed, the bottle is quickly inverted and its neck portion is placed in a dispensing device as partially shown in FIG. 5. The bottle is supported vertically by a sealing ring 50 around an opening in a chamber (not shown) for receiving water. The seal prevents foreign matter from entering the chamber and contaminating the water. It may be noted from FIG. 5 that the radial extent A of a closure of this invention, when combined with the bottle, exceeds the diameter of the opening in the sealing ring 50 and thus the entire exterior surface of the bottle exposed to the water while the water is being dispensed has been protected from contamination by using a closure of this invention.

Figure 6:
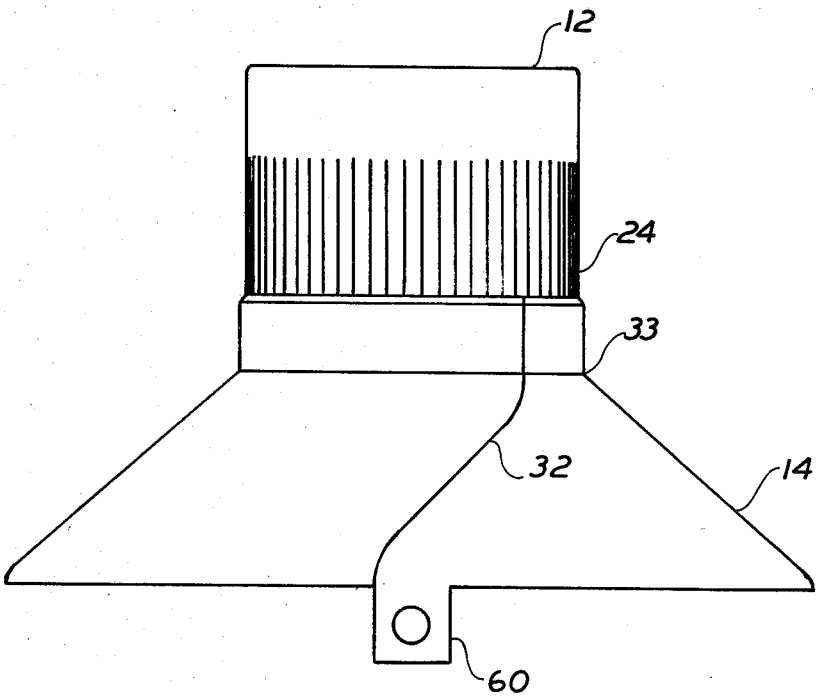
FIG. 6 is an elevation view of an alternate embodiment of a closure of this invention.

An alternate embodiment of the present invention is shown in FIG. 6. In this embodiment, a pull tab 60 extends downward from the collar 14 and a single groove 32 extends in the collar from the tab 60 and then extends vertically upward in the skirt wall 24 a distance sufficient to enable removal of the closure when the closure is torn along the groove 32.

It is noted that an embodiment of the present invention can also include a reusable cap 12 by providing a spiral screw thread on the interior surface of skirt wall 24 to engage a corresponding screw thread on the bottle 40. If it is desired that the closure incorporate a reusable cap 12, a circumferential line of weakness 33 is provided at the junction between the skirt wall 24 and the collar 14 and the groove 32 terminates at its upper extent at line of weakness 33. In this embodiment the collar is torn away along grooves 32, 33 and the cap portion 12 is then unscrewed to make the content of the bottle available for dispensing.

What is claimed is:

1. A tear-off closure for a bottle having a substantially vertical neck with an open mouth therein and a wall flaring outwardly and downwardly from the neck, the neck and a portion of the outwardly and downwardly flaring wall to be shielded from contamination, said closure comprising:

an end wall;

a substantially vertical skirt wall depending from the periphery of said end wall;

a substantially frustoconically shaped imperforate collar flaring at an angle with said skirt wall downwardly and outwardly from a bottom edge of said skirt wall, said collar being adapted to intimately contact the outwardly and downwardly flaring bottle wall outwardly of the portion of the wall to be protected from contamination by providing a lesser inside angle between vertical and said outwardly flaring collar than an inside angle between vertical and the outwardly flaring bottle;

at least one line of weakness in said collar extending upward from a bottom edge of said collar; and gripping means for tearing the closure along said line of weakness.

2. A closure as described in claim 1 wherein said gripping means is a grippable portion of said collar projecting upward from an upper surface of the collar.

3. A closure as described in claim 1 wherein said gripping means is a tab adjacent a bottom terminal edge of said collar.

4. A closure as described in claim 1 wherein said line of weakness further extends upward in at least a portion of said skirt wall.

5. A closure as described in claim 1 which further includes a circumferential line of weakness at the junction of said skirt wall and said collar.

6. A closure as described in claim 1 which further includes a central plug portion depending from said end wall.

7. A closure as described in claim 1 which further includes a closure engaging means for engaging the closure with a bottle.

8. A closure as described in claim 7 wherein said closure engaging means is an inwardly projecting annular band on the interior surface of said skirt wall.

* * * * *